US007178185B1

(12) United States Patent
Nattler

(10) Patent No.: US 7,178,185 B1
(45) Date of Patent: Feb. 20, 2007

(54) CONVERTIBLE BLANKET

(76) Inventor: Gerlinde Maria Nattler, 973 Hampstead La., Rochester Hills, MI (US) 48309

( * ) Notice: Subject to any disclaimer, the term of this patent is extended or adjusted under 35 U.S.C. 154(b) by 0 days.

(21) Appl. No.: 11/329,735

(22) Filed: Jan. 12, 2006

(51) Int. Cl.
*A47G 9/04* (2006.01)
*A47G 9/08* (2006.01)
*A44B 1/04* (2006.01)

(52) U.S. Cl. ..... 5/482; 5/486; 2/88; 2/84; 24/303; 24/72.5

(58) Field of Classification Search ..... 5/482, 5/486; 2/84, 88; 24/72.5, 303
See application file for complete search history.

(56) References Cited

U.S. PATENT DOCUMENTS 4,142,264 A * 3/1979 Whiting ..... 5/482
4,217,662 A 8/1980 Buchman
4,258,439 A * 3/1981 York ..... 2/69.5
5,588,749 A * 12/1996 Ishikawa ..... 383/4
5,604,960 A * 2/1997 Good ..... 24/303
5,611,095 A * 3/1997 Schneider ..... 5/482
5,875,492 A * 3/1999 Moss ..... 2/93
5,887,299 A * 3/1999 Phillips ..... 5/413 R
6,378,174 B1 * 4/2002 Wong ..... 24/303

* cited by examiner

*Primary Examiner*—Michael Trettel

(57) ABSTRACT

A blanket (1) is provided with magnetic closure elements (21–50) along its edge (2) that allow a conversion into a robe, a sleeping bag, or other shapes. Since magnetic forces don't require direct contact, the magnetic closures can be fabric-covered and thus hidden. No attention needs to be paid to the polarity of the magnets if they are paired with ferromagnetic counterparts. A hood (51) can be attached, or two smaller blankets, which each can from a jacket, can be connected to form one larger blanket convertible into a robe.

13 Claims, 3 Drawing Sheets

CONVERTIBLE BLANKET

BACKGROUND OF THE INVENTION

The present invention relates to a blanket or comforter which is provided with closure members that allow conversion into a robe, a sleeping bag, or other shapes.

Such a blanket is known, for example, from U.S. Pat. No. 4,217,662. the prior art comforter or blanket has several snaps and a zipper provided along its edge so that, if the zipper is zipped up and the snaps closed, it becomes a lounger or robe. Such blankets have the advantage that their use is not limited to providing cover when lying down. The robe can be worn while sitting or even walking without having to hold it in place. The mechanical closure members, i.e. the snaps and the zipper, connect portions of the blanket's edge, which thus provides warmth for the wearer in the front and in the back.

A disadvantage of this arrangement is that the snaps and the zipper may get tangled in the user's hair or cause snags in the user's clothes, in particular when not closed.

Additionally, the appearance of such a blanket is not very eye-pleasing due to the visible mechanical closure members.

It is therefore the objective of the present invention to provide a blanket of the afore-mentioned kind that provides at least the same degree of convertibility without the risk of causing damage to clothes or hair and without the need for visible mechanical closure members.

SUMMARY OF THE INVENTION

This objective is achieved by a blanket that comprises magnetic closures along its edge. Since magnetic forces don't require direct contact, the magnetic closures can be fabric-covered and thus hidden. Fabric in this context is not limited to woven or knitted materials. It can also be non-woven material like felt or leather, vinyl, suede, or the like.

Nowadays, even small permanent magnets are strong enough to hold name badges on clothes, for instance. Ceramic magnets are cheap and strong enough to hold blanket edges together.

No attention needs to be paid to the polarity of the magnets if they are paired with ferromagnetic counterparts, which are attracted to a magnet regardless of its polarity. Additionally, only half the number of magnets is necessary compared to using exclusively magnets to connect the sides of the blanket. While magnets are inexpensive, metal plates are even cheaper.

A symmetric arrangement of permanent-magnetic closure members on the one hand and ferromagnetic counterparts on the other hand with respect to an axis of symmetry allows for folding the blanket along this axis of symmetry and connecting the flush sides, thus providing a sleeping bag, for instance.

With two axes of symmetry, even more variations are possible. For instance, a rotation by 180 degrees will result in the same constellation of magnetic closures and counterparts so that there is no designated top or bottom. Either orientation will work when converting the blanket to a robe.

It is also possible to connect two or more pieces to create one larger blanket or to attach a hood with closure elements paired with corresponding closure elements along the blanket's edge.

Magnetic closures are not limited to one specific way of connecting the portions of the edge. They can be used for a flush or overlapping connection. Likewise, there is no designated right or wrong side since the closure elements, i.e. the magnetic closure members and the counterparts, are fabric-covered and work on either side. Thus, if the blanket is manufactured from two different layers of material or two different designs, it can be converted to different robes by turning the blanket inside out or upside down.

The closure elements can be attached to the edge of the blanket by first arranging them in a thin fabric tube that may be divided into pockets so that the elements cannot shift along the tube and by attaching the tube to the blanket edge and covering it with blanket material or binding.

Instead of inserting the elements into pockets, they can also be fused to a fabric tape or binding by means of an adhesive or heat. This may be a less labor-intensive process, which can be automated. Another alternative would be to shape the closure elements or provide them with carrier elements in a way that they can be directly sewn, crimped, or riveted onto fabric. It is evident that there is a large variety of methods to attach the closure elements to the blanket, and the invention is not limited to the examples mentioned here.

The exact arrangement as well as the number and the shapes of the magnetic closure members and counterparts are subject to individual judgement, depending on the measurements of the blanket and the desired conversion. At the present, flexible magnetic tapes or strips as currently used for magnetic business cards, for instance, are not flexible enough to be folded with fabric and may also, in their common form, not be strong enough. But should a more flexible and sufficiently strong tape be available, providing the blanket with continuous magnetic strips would be a viable option as well.

Further details and advantages of the invention will be explained by means of the description of the accompanying drawings.

DETAILED DESCRIPTION OF THE DRAWINGS

Figure 1:
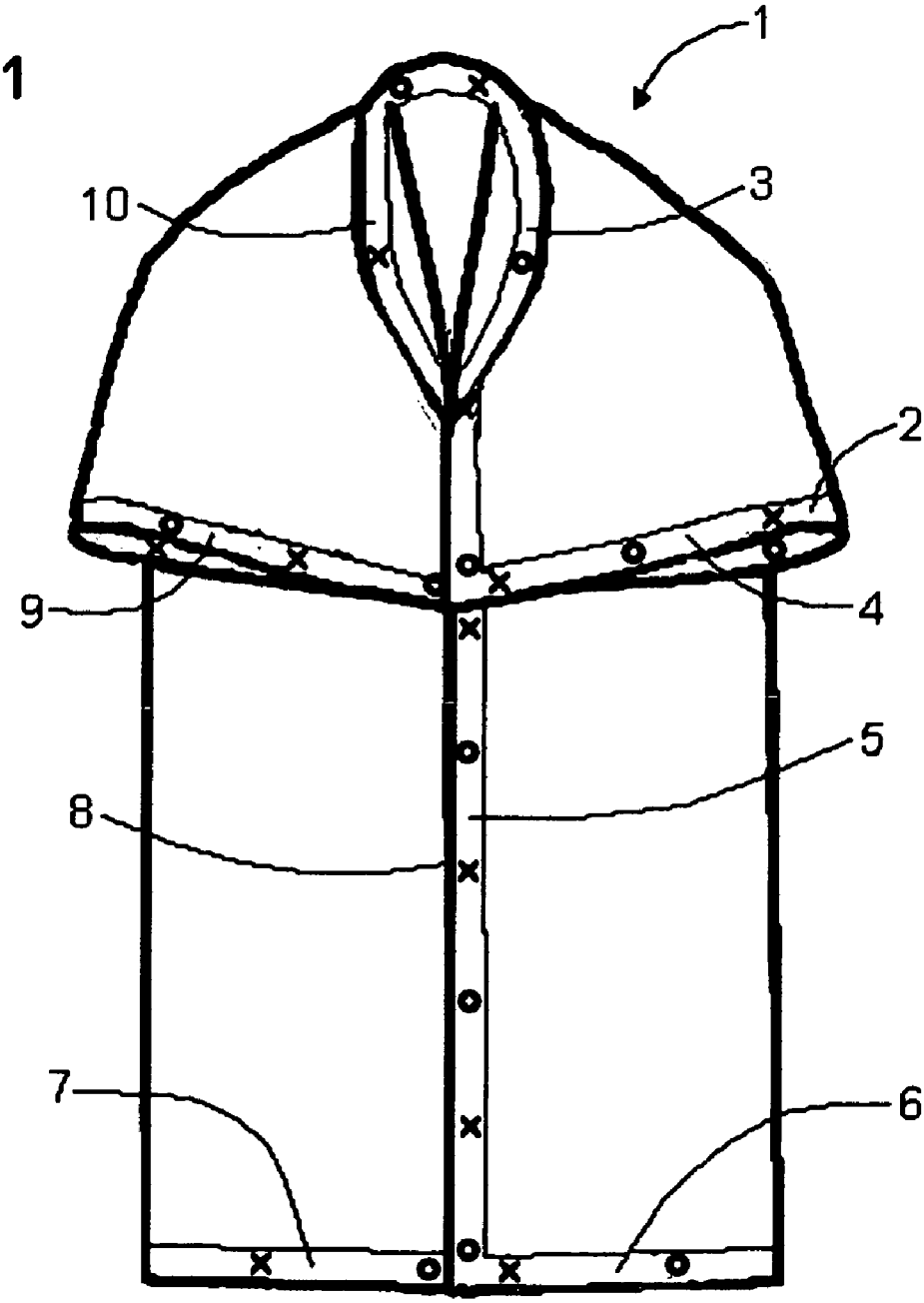
FIG. 1 shows a robe converted from a blanket according to the present invention.

FIG. 1 shows the convertible blanket 1 folded into a robe. The folding technique itself is known from the prior art. In contrast to known convertible blankets, the blanket according to the present invention is provided with permanent-magnetic closure members, schematically represented by symbols "x", and with ferromagnetic counterparts represented as symbols "o". These closure elements, i.e. the closure members and counterparts, are in reality virtually invisible because they are hidden in a fabric-covered edge 2.

Figure 2:
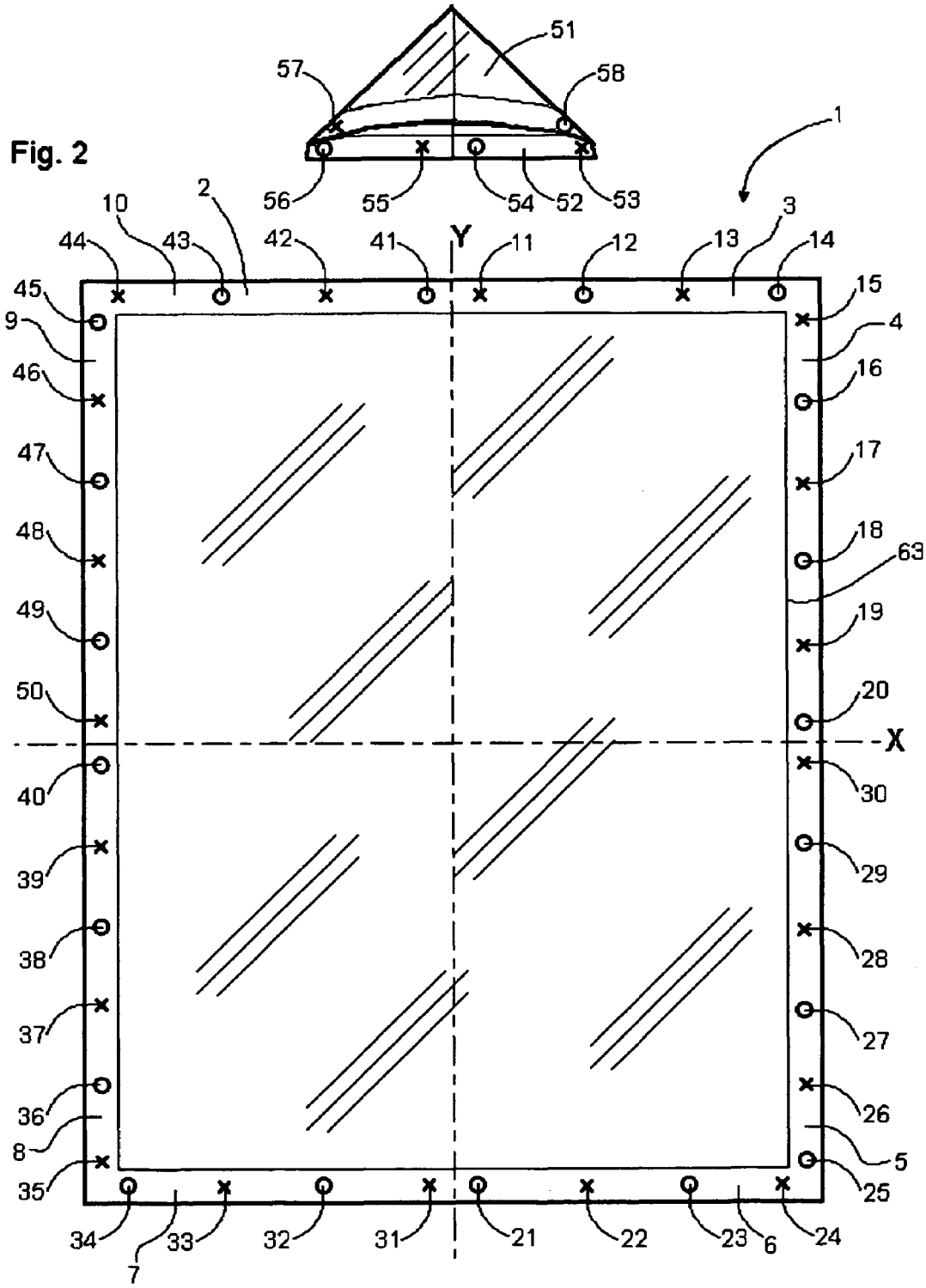
FIG. 2 shows a blanket according to the present invention and an attachable hood.

A better understanding of the arrangement of the closure elements can be obtained from FIG. 2, where the blanket 1 is shown unfolded.

The blanket 1 is of rectangular shape, e.g. approximately 60"×80" and is surrounded by the edge 2, which accommodates the closure elements 11–50 and is attached to the blanket material by means of a seam 63. The closure elements 11–50 are distributed over all four sides of the edge. Permanent-magnetic closure members are arranged in alternating order with ferromagnetic counterparts.

The blanket has two axes of symmetry, X and Y, which are perpendicular to each other. With respect to these axes, the counterparts are arranged in the mirror positions of the closure members. For instance, the closure members 11, 13, 15, 17, and 19 in sections 3 and 4 are mirrored with respect to axis X in the counterparts 21, 23, 25, 27, and 29 in sections 6 and 5, and with respect to axis Y in the counterparts 41, 43, 45, 47, and 49 in sections 10 and 9.

The reference numerals of the closure elements were chosen in a way that each quarter of the edge stretching from axis Y to axis X occupies one decade of numbers. These numbers are 11–20 for the 12 o'clock to 3 o'clock stretch (sections 3 and 4), 21–30 counterclockwise for the 6 o'clock to 3 o'clock stretch (sections 6 and 5), 31–40 for the 6 o'clock to 9 o'clock stretch (sections 7 and 8) and 41–50 counterclockwise for the 12 o'clock to 9 o'clock stretch (sections 10 and 9). Accordingly, the second digits of matching closure elements correspond to each other.

In order to obtain a robe as shown in FIG. 1, closure elements 25–30 of section 5 are paired with their mirror elements across axis Y, i.e. elements 35–40 of section 8. Then closure member 13 connects to counterpart 43 and counterpart 14 to closure member 44. Finally, closure member 15 is connected to counterpart 20, counterpart 16 to closure member 19, counterpart 45 to closure member 50, and closure member 46 to counterpart 49. In order to arrange for these pairs or closure elements, the distances between the closure elements even within one section need to match where connections are made within the same section. For simplicity purposes, the closure elements within one section are arranged in equal distances to each other and in alternating order. However, this arrangement is only one of many possible options that can be adopted to manufacture a convertible blanket according to the present invention.

For assembling the robe of FIG. 1, closure elements 11, 12, 17, 18, 21–14, 31–34, 447, 48, 41, and 42 are not crucial. However, closure members 24 and 23 can be paired with 21 and 22, respectively, and 34 and 33 with 31 and 32, respectively, as well. Then the robe provides a closed bottom to keep the wearer's feet warm when the wearer is in a sitting position.

The unused closure members 11, 12, 41, and 42 along the neckline are useful to attach a hood 51 as shown in FIG. 2. To this end, the hood, which can be tailored to reflect better anatomical fit, includes matching closure elements 53–56 along its edge 52, which are arranged in the same distance to each other as the closure elements 12, 11, 41, and 42 along the neckline of the robe. In the shown example, the hood also includes one additional closure member 57 and one additional counterpart 58, which can be connected to each other to ensure a closer fit around the neck and face of the wearer.

Finally, the closure elements 17, 18, 47, and 48 serve symmetry purposes and are also provided for the event that the blanket is, for instance, converted into a sleeping bag by connecting section 4 and 5 with sections 9 and 8 and by closing the bottom, i.e. sections 6 and 7. They also eliminate the need to find the designated top of the robe, since a rotation by 180° will result in the same constellation of closure elements. Thus the orientation of the blanket is irrelevant.

Likewise, turning the blanket over to its other side will still result in a successful assembly of the robe since magnets attract ferromagnetic materials regardless of the orientation of their poles and since the closure elements are fabric covered without ugly backsides.

It is also possible to separate the blanket into two halves along axis X, i.e. to provide two smaller blankets. Each of these smaller blanket can be converted into a shorter robe in a jacket-like construction. The bottom side of the upper smaller blanket can be provided with an edge portion as seen in sections 6 and 7. Then it can be connected to an identical smaller blanket and converted from a jacket to a long robe.

Figure 3:
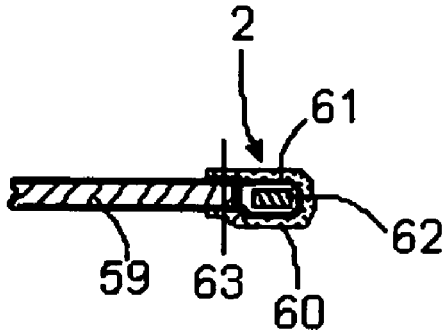
FIG. 3 shows a first embodiment of a blanket edge.

FIG. 3 shows a first example of a possible construction of the edge 2. The blanket material 59 is provided with a blanket binding 60 consisting of fabric or a fabric-like material. Inside the binding, a thin fabric or fabric-like tube 61 is arranged which accommodates a magnetic closure member 62, representative for any closure member of FIG. 2. Both the binding 60 and the tube 61 are connected to the blanket material 59 by means of a seam through all layers as indicated by vertical line 63.

Figure 4:
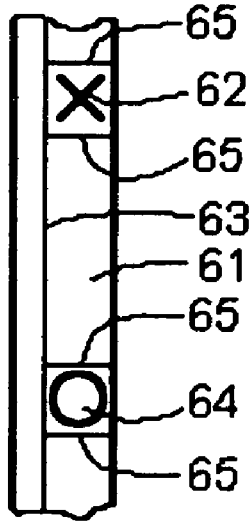
FIG. 4 shows a detail of a blanket edge.

The inner tube 61 is shown in close detail in FIG. 4. FIG. 4 is a top view on the inner tube 61 of FIG. 3. The tube 61 is divided by seams 65 into pockets accommodating magnetic closure member 62 and a ferromagnetic counterpart 64, representative for any counterpart shown in FIG. 2. The pockets are sized in a way that the closure elements are held in place and cannot slip along the tube. When the tube is sewn onto the blanket material, seam 63 closes the pockets and thus secures the closure elements in place. It is, of course, also possible to secure the closure elements first and then to attach the tube to the blanket or to attach the tube and the blanket binding in successive steps with separate seams.

If the closure elements are directly attached to the inside of the binding, for instance by means of an adhesive, heat fusing, or the like, an inner tube is unnecessary.

Also, if the closure members can be directly riveted or sewn onto fabric, i.e. by a method penetrating the fabric, a carrier tape is sufficient, which does not have to form a tube since no pockets are necessary.

Figure 5:
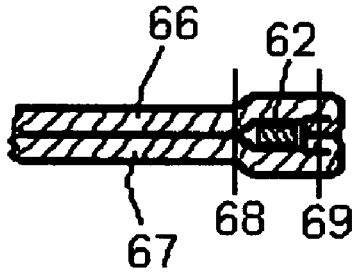
FIG. 5 shows a second embodiment of a blanket edge.

FIG. 5 shows an arrangement without blanket binding. In this embodiment, the blanket consists of two layers 66 and 67 of material. A first seam 68 defines the borderline to the blanket edge, and a second seam 69 closes this edge toward the outside, thus providing a tube accommodating the closure member 62. An inner tube, not shown in this example, can be provided for the same reasons as given in connection with FIGS. 3 and 4 if the closure member 62 is not directly attached to the blanket material.

Figure 6:
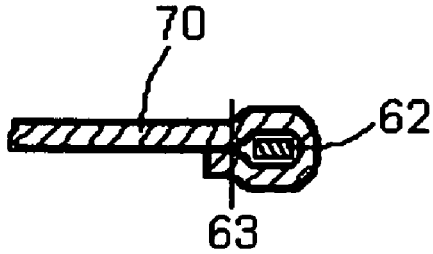
FIG. 6 shows a third embodiment of a blanket edge.

The simplest edge construction is shown in FIG. 6, where the blanket material 70 is simply folded over and sewn in place by seam 63. Magnetic closure member 62 is accommodated in the thus created tube. Just as in the other examples, an inner tube or carrier tape can be considered to keep the closure elements from shifting.

The previous examples only represent a small fraction of possibilities to put the present invention into practice and should not be viewed as limiting the invention to the selected details.

What is claimed is:

1. A convertible blanket with a surrounding edge, wherein a plurality of fabric-covered permanent-magnetic closure members is arranged along at least a portion of the edge, wherein the edge is trimmed with a fold-over binding and the closure members are arranged inside the binding.

2. The blanket according to claim 1, wherein additionally a plurality of fabric-covered ferromagnetic counterparts cooperating with the closure members is arranged along at least a portion of the edge.

3. The blanket according to claim 2, wherein the number of counterparts is the same as the number of closure members.

4. The blanket according to claim 3, wherein the shape of the blanket has at least one axis of symmetry and the closure members are arranged in mirror symmetry to the counterparts with respect to the at least one axis of symmetry.

5. The blanket according to claim 4, wherein the blanket has two axes of symmetry.

6. The blanket according to claim 2 with a rectangular shape, wherein the closure members and counterparts are arranged in a way that closure members and counterparts can be paired up to convert the blanket into a robe.

7. The blanket according to claim 6, wherein each of the four sides of the edge carries closure members as well as counterparts.

8. The blanket according to claim 2, wherein the closure members and counterparts are arranged in a way that closure members and counterparts can be paired up to convert the blanket into a sleeping bag.

9. The blanket according to claim 2, wherein closure members and counterparts are arranged in an alternating order.

10. The blanket according to claim 1, wherein the closure members are sewn inside a tube of thin fabric which runs along the blanket edge and is covered by the binding.

11. The blanket according to claim 10, wherein the tube is divided into pockets containing the closure members and thus limiting movement of the closure members along the tube.

12. A convertible blanket with a surrounding edge, wherein a plurality of fabric-covered permanent-magnetic closure members is arranged alone at least a portion of the edge, wherein the closure elements are arranged between two layers of blanket material, and wherein the blanket comprises at least two layers of fabric which are sewn together along at least a portion of the edge at a small distance from the edge and at the edge itself and wherein the closure members are arranged between the two seams.

13. A convertible blanket with a surrounding edge, wherein a plurality of fabric-covered permanent-magnetic closure members is arranged along at least a portion of the edge, wherein the closure elements are arranged between two layers of blanket material, and wherein the two layers are formed by blanket material folded over along the edge.

* * * * *